US011305337B2

(12) United States Patent
Lee et al.

(10) Patent No.: US 11,305,337 B2
(45) Date of Patent: Apr. 19, 2022

(54) METHOD OF FORMING CASTING WITH FLOW PASSAGE, AND CASTING FORMED BY THE SAME

(71) Applicants: HYUNDAI MOTOR COMPANY, Seoul (KR); KIA MOTORS CORPORATION, Seoul (KR)

(72) Inventors: Ji-Yong Lee, Seoul (KR); Cheol-Ung Lee, Busan (KR); Young-Rae Jo, Hwaseong-si (KR); Jin-Ho Yoo, Incheon (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 57 days.

(21) Appl. No.: 16/693,987

(22) Filed: Nov. 25, 2019

(65) Prior Publication Data

US 2020/0171563 A1 Jun. 4, 2020

(30) Foreign Application Priority Data

Dec. 4, 2018 (KR) ..... 10-2018-0154402

(51) Int. Cl.
*B22C 9/10* (2006.01)
*B22D 19/00* (2006.01)
*B22D 17/00* (2006.01)

(52) U.S. Cl.
CPC ..... *B22C 9/10* (2013.01); *B22D 17/00* (2013.01); *B22D 19/00* (2013.01)

(58) Field of Classification Search
CPC ..... B22C 9/10–108; B22D 19/0009–16
See application file for complete search history.

(56) References Cited

U.S. PATENT DOCUMENTS

| | | | | |
|---|---|---|---|---|
| 3,011,232 | A | 12/1961 | Hawkins et al. | |
| 5,316,070 | A | 5/1994 | Rogers et al. | |
| 2017/0074205 | A1* | 3/2017 | Maki | B22D 25/02 |

FOREIGN PATENT DOCUMENTS

| | | | |
|---|---|---|---|
| KR | 10-2000-0017994 | A | 4/2000 |
| KR | 10-1826017 | B1 | 2/2018 |
| WO | 2013/149955 | A1 | 10/2013 |
| WO | 2018/141521 | A1 | 8/2018 |

OTHER PUBLICATIONS

Extended European Search Report dated Dec. 16, 2019 issued in European Patent Application No. 19209368.0.

* cited by examiner

*Primary Examiner* — Adam Krupicka
(74) *Attorney, Agent, or Firm* — Morgan, Lewis & Bockius LLP

(57) ABSTRACT

A method of forming a casting with a flow passage may include forming a core obtained by filling a tubular pipe with a filler; inserting the core into a mold having a cavity corresponding to a shape of the casting to be formed; performing a casting process by injecting molten metal into the cavity; and removing the filler from the core, wherein the casting process is performed through a high-pressure casting process.

6 Claims, 4 Drawing Sheets

PRIOR ART

METHOD OF FORMING CASTING WITH FLOW PASSAGE, AND CASTING FORMED BY THE SAME

CROSS-REFERENCE(S) TO RELATED APPLICATIONS

The present application claims priority to Korean Patent Application No. 10-2018-0154402, filed on Dec. 4, 2018 in the Korean Intellectual Property Office, the entire disclosure of which is incorporated herein by reference.

TECHNICAL FIELD

Exemplary embodiments of the present disclosure relate to a method of forming a casting; and, particularly, to a method of forming a casting with a flow passage formed therein, and a casting formed by the method.

BACKGROUND

Recently, as electric vehicles, hybrid vehicles, etc. have been developed more actively, a variety of power converting components such as a driving motor, an inverter, or a converter have substituted for conventional components for an internal combustion engine such as an engine or a transmission.

Such power converting components may generate relatively more heat during processes of charging electricity and converting the charged electricity into power to be used, compared to conventional components.

Hence, a flow passage for cooling is necessarily required for such power converting components in a similar manner to other components that generate a lot of heat.

Conventionally, to form a flow passage in a component produced through a casting process, two parts with flow passages are formed through casting processes and coupled with each other by bolts 3 or the like, and a gasket 2 is interposed between the two parts to secure the airtightness of the interface therebetween, as shown in FIG. 1. In this way, a casting 1 with a flow passage 4 is produced.

In such a conventional method, a process of forming a casting is complex because two pieces of parts should be manufactured individually and then coupled with each other through a mechanical coupling scheme. In addition, if an interior of the casting 1 is defective or the gasket 2 is damaged, leakage may be caused, whereby water may permeate into a power semiconductor. In this case, a related system may malfunction, and fire may occur in a vehicle. Therefore, development of a technique for enhancing the robustness of a flow passage of a power converting component is required.

The information included in this Background section is only for enhancement of understanding of the general background of the present disclosure and may not be taken as an acknowledgement or any form of suggestion that this information forms the prior art already known to a person skilled in the art.

SUMMARY

An embodiment of the present disclosure is directed to a method of forming a casting with a flow passage and a casting formed by the method, which may reduce the production cost and enhance the robustness of an internal flow passage.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with an exemplary embodiment of the present disclosure, a method of forming a casting with a flow passage may include: forming a core obtained by filling a tubular pipe with a filler; inserting the core into a mold having a cavity corresponding to a shape of the casting to be formed; performing a casting process by injecting molten metal into the cavity; and removing the filler from the core, wherein the casting process is performed through a high-pressure casting process.

The forming of the core may include: filling the tubular pipe with the filler; drawing and extruding the tubular pipe filled with the filler; and bending the tubular pipe in a shape corresponding to a shape of the flow passage to be formed in the casting.

The molten metal and the tubular pipe may be formed of an identical material.

The tubular pipe may be formed of aluminum.

The filler may be any one or more selected from salt, sand, iron powder, and a resin coated sand.

A thickness of the tubular pipe may be greater than 1.25 mm or more and less than 4 mm.

In accordance with an embodiment of the present disclosure, there is provided a casting formed integrally with a tubular pipe bent in a shape of a flow passage through an insert casting process, wherein the tubular pipe is formed of a material identical with a material of the casting.

Molten metal and the tubular pipe may be formed of aluminum.

A thickness of the tubular pipe may be greater than 1.25 mm or more and less than 4 mm.

In a method of forming a casting with a flow passage according to the present disclosure, a casting is integrally formed into one piece using a core which includes a tubular pipe filled with a filler, unlike the conventional method of manufacturing a component having a flow passage in which the casting is formed into two pieces. Therefore, there are economic advantages.

Furthermore, not only a power converting component but also any component having a flow passage can have an enhanced robustness, compared to those manufactured by the conventional method. Therefore, risks such as a vehicle fire may be prevented.

DETAILED DESCRIPTION

Exemplary embodiments of the present disclosure will be described below in more detail with reference to the accompanying drawings so as to make those skilled in the art fully understand operational advantages and objects of the present disclosure.

If in the specification, detailed descriptions of well-known functions or configurations would unnecessarily obfuscate the gist of the present disclosure, the detailed descriptions will be shortened or omitted.

Figure 1:
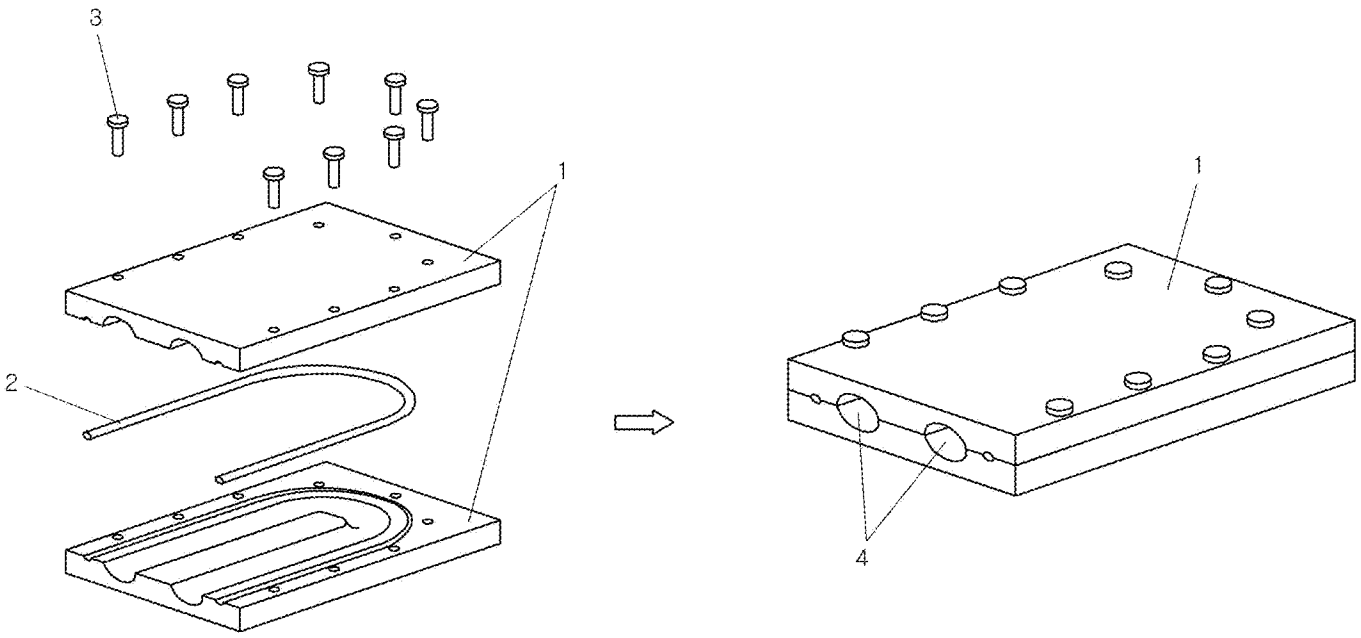
FIG. 1 illustrates a conventional method of forming a casting with a flow passage.
Figure 2:
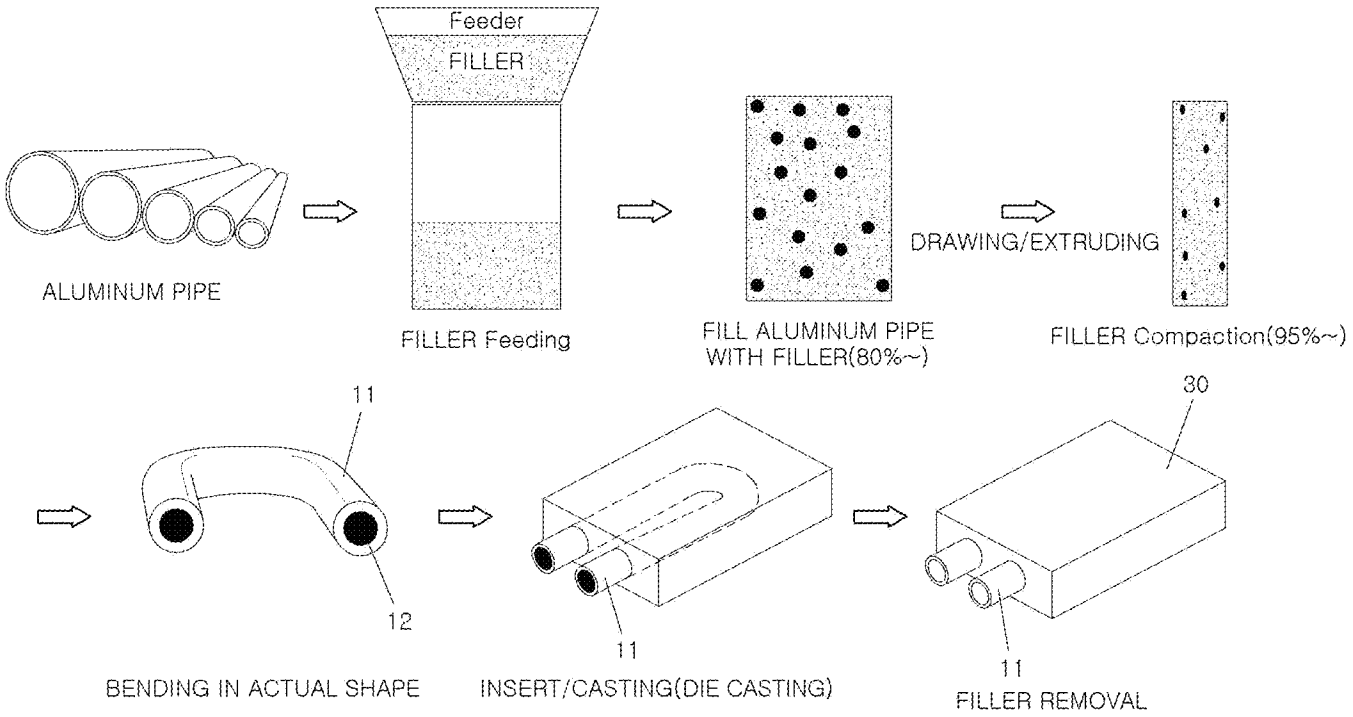
FIG. 2 illustrates a method of forming a casting with a flow passage according to one exemplary embodiment of the present disclosure.

FIG. 2 illustrates a method of forming a casting with a flow passage according to one exemplary embodiment of the present disclosure. Hereinafter, a method of forming a casting with a flow passage, and a casting formed by the method in accordance with an exemplary embodiment of the present disclosure will be described with reference to FIG. 2.

According to an exemplary embodiment of the present disclosure, a method of forming a casting with a flow passage may include forming the casting and the flow passage integrally into one piece through a casting process using a core having a tubular pipe 11 filled with a filler 12, a so-called "smart core," whereby the robustness of the flow passage can be secured and there are economic advantages.

To achieve the above purposes, in the method according to an exemplary embodiment of the present disclosure, a cylindrical pipe to be formed into a flow passage is prepared.

Although an aluminum pipe is illustrated in the drawing, the present disclosure is not limited thereto.

However, in the case where aluminum material is used to form a casting, an aluminum pipe may be used. According to an exemplary embodiment of the present disclosure, the casting may include Aluminum (Al) as a base or a majority of the composition, and Copper (Cu) of 5.0 wt % or less, Silicon (Si) of 18.0 wt % or less, Magnesium (Mg) of 8.6 wt % or less, Zinc (Zn) of 3.0 wt % or less, Iron (Fe) of 1.8 wt % or less, Manganese (Mn) of 0.6 wt % or less, Nickel (Ni) of 0.5 wt % or less, and Tin (Sn) of 0.3 wt % or less, with reference to the total weight.

Thereafter, the tubular pipe 11 is filled with a filler 12 by at least 80% using a feeder.

Since the filler 12 is removed in a final stage, fine particles such as salt particles or sand may be used as the filler 12. For example, salt, sand, iron powder, etc. may be used, or a resin coated sand may be used.

The reason why the tubular pipe 11 is filled with the filler 12 is to make it possible for the smart core to endure pressure generated during die casting.

Subsequently, the tubular pipe 11 filled with the filler 12 is reduced in cross-sectional area and increased in length by drawing and extruding so that the internal filler can be compacted to at least about 95%.

Furthermore, opposite ends of the tubular pipe 11 are filled with resin or the like so as to prevent the internal filler from leaking out.

In the case where the opposite ends of the tubular pipe 11 are filled with resin, during a subsequent filler removing process, the portions of the tubular pipe 11 that are filled with the resin are cut out, and thereafter the filler 12 is removed.

Subsequently, the smart core in which the tubular pipe 11 is filled with the filler 12 is completed by bending the tubular pipe 11 in a shape corresponding to an actual shape of the flow passage.

Although the step of bending the tubular pipe 11 is illustrated in the drawing, the present disclosure is not limited thereto.

In the present disclosure, the smart core manufactured through the above-mentioned process is inserted into a mold formed in the form of a target product and processed by die casting, thus embodying a desired casting.

In the smart core according to an exemplary embodiment of the present disclosure, since the tubular pipe 11 configured to form the flow passage is compactly filled with the filler 12, it is possible to perform a casting process without deformation of the smart core even by molten metal injected at high pressure generated by high-pressure casting.

Furthermore, the material of the tubular pipe 11 depends on the material a target casting to be formed.

Particularly, in the case where aluminum is used as molten metal, the tubular pipe 11 is also manufactured using aluminum. Thus, the tubular pipe 11 may be integrally joined with the casting when the casting process is performed after the insert process. In this case, the thermal conductivity is increased by aluminum, whereby the cooling performance can be enhanced. A joining interface may be formed within 30 μm, and more preferably, the tubular pipe 11 may be joined with the casting without an interface.

In other words, although the tubular pipe 11 and the molten metal are the same material, and particularly, are formed of aluminum, this means that base materials of alloys used to form the tubular pipe 11 and the molten metal are the same as each other, and detail components of the alloys may differ from each other.

If, when a casting is formed through a high-pressure casting process to produce an aluminum part, a tubular pipe formed of steel is used for the smart core, an interface ranging from 300 μm to 500 μm is formed between an aluminum surface and a steel surface and the thermal conductivity may be reduced although an undesirable compression phenomenon does not occur.

Figure 3:
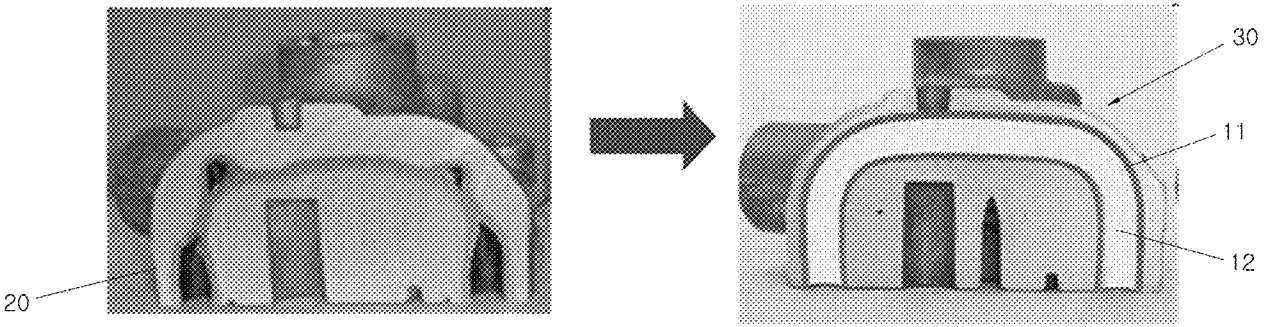
FIG. 3 illustrates a cross-sectional shape of a casting formed by the method according to one exemplary embodiment of the present disclosure and a cross-sectional shape of a casting according to a comparative example.

Furthermore, as shown in FIG. 3, in the case of a tubular pipe 20 formed of aluminum without filler unlike of the smart core according to an exemplary embodiment of the present disclosure, the tubular pipe 20 may be compressed during a high-pressure casting process, as illustrated in the drawing. Therefore, it is impossible to form a normal casting.

If a casting is formed through a low-pressure casting process or a gravity casting process inserting an aluminum tubular pipe, the aluminum tubular pipe can be deformed by heat due to a relatively long casting process.

After the above-mentioned casting process has been completed, the filler is removed from the smart core by means of air or the like. As a result, the desired casting 30 is completed. Here, a method of removing the filler may be changed depending on the kind of filler.

In other words, in the case where crystallized particles such as salt is used as the filler 12, it is preferable that a physical removal scheme of applying a water jet of 200 bar or more to the tubular pipe 11 is used.

In the case where uncrystallized particles such as sand are used as the filler 12, the filler 12 may be removed by injecting a water jet of 200 bar or more or air of 2 bar into the tubular pipe 11.

Furthermore, in the case where a resin coated sand is entirely or partially used as the filler 12, the filler 12 may be removed by burning resin included in the mixture through heat treatment at 400° C. and then injecting a water jet of 200 bar or more or air of 2 bar or more.

As described above, according to an exemplary embodiment of the present disclosure, the flow passage is formed in the casting 30 in a shape corresponding to the smart core. The casting 30 may be formed into one piece through a single casting process.

Therefore, the robustness of the flow passage formed in the casting can be secured, and the production cost may be reduced.

Furthermore, since the tubular pipe 11 of the smart core of the present disclosure is inserted during a high-pressure casting process, the thickness (t) thereof is required to be limited to at least 1.25 mm.

In the case where the thickness of the tubular pipe 11 is 1.25 mm or less, the tubular pipe 11 may be melted in molten aluminum of 600° C. during a casting process.

In a typical die-casting process, the average time it takes to produce a product ranges from 45 seconds to 100 seconds. 80% of this time is used for cooling the product.

In other words, the time it takes for molten metal ranging from 660° C. to 680° C. to be cooled to a range from 200° C. to 250° C. after the molten metal comes into contact with the pipe approximately ranges from 35 seconds to about 80 seconds. Here, the pipe is required to stand high-temperature heat of the molten metal. If the thickness of the pipe is less than 1.25 mm, the pipe may be partially melted by the molten metal and thus lose its function.

Therefore, it is preferable that the thickness of the pipe of the smart core which is used in the high-pressure casting process according to an exemplary embodiment of the present disclosure be at least 1.25 mm.

Figure 4:
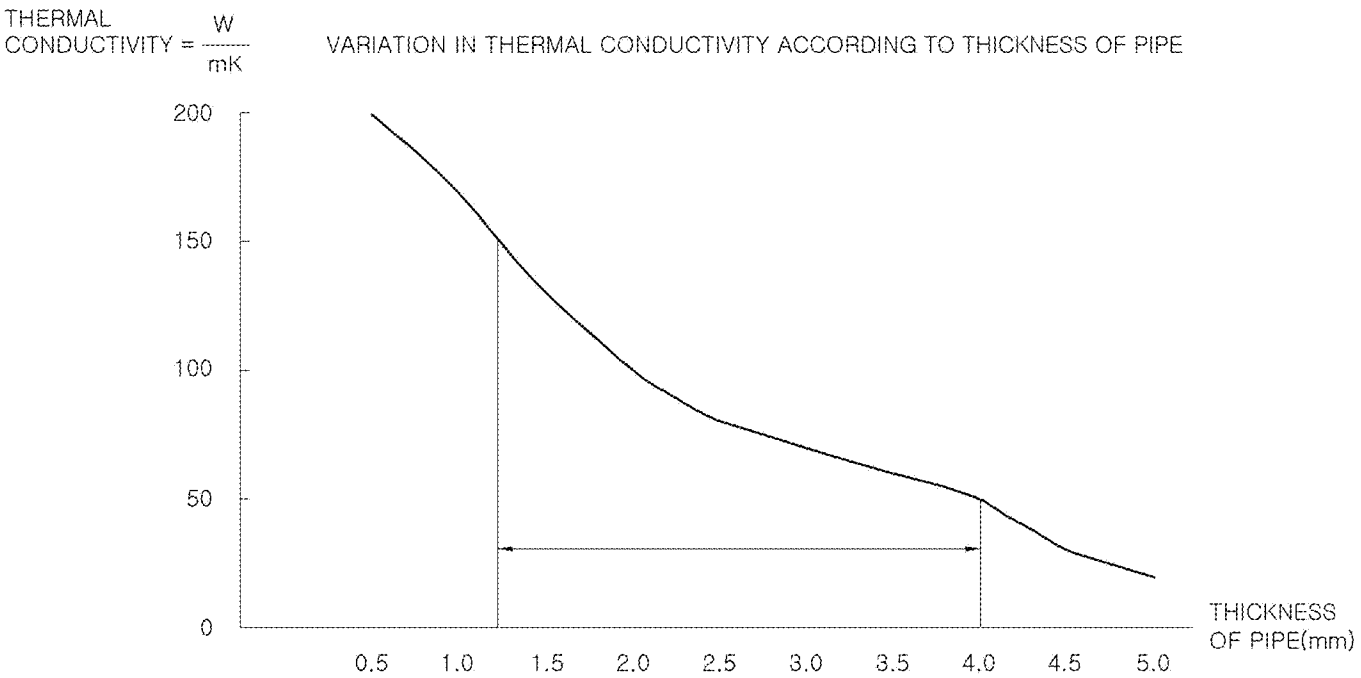
FIG. 4 illustrates a relationship between thermal conductivity and a thickness of a cylindrical pipe.

In addition, referring to FIG. 4, since if the thickness of the pipe is 4 mm or more the thermal conductivity falls below 50 W/(m·K), it is preferable that the thickness of the pipe be less than 4 mm in terms of thermal conductivity.

While the present disclosure has been described with respect to the specific embodiments, it will be apparent to those skilled in the art that various changes and modifications may be made without departing from the spirit and scope of the invention as defined in the following claims.

While the present disclosure has been described with respect to the specific embodiments, it will be apparent to those skilled in the art that various changes and modifications may be made without departing from the spirit and scope of the disclosure as defined in the following claims.

What is claimed is:

1. A method of forming a casting with a flow passage, comprising:

forming a core obtained by filling a tubular pipe with a filler;

inserting the core into a mold having a cavity corresponding to a shape of the casting to be formed;

performing a casting process by injecting a molten metal into the cavity; and removing the filler from the core, wherein the casting process is performed through a high-pressure casting process, wherein the forming the core comprises:

filling the tubular pipe with the filler; and drawing and extruding the tubular pipe filled with the filler.

2. The method of claim 1, wherein the forming the core further comprises:

bending the tubular pipe in a shape corresponding to a shape of the flow passage to be formed in the casting.

3. The method of claim 1, wherein the molten metal and the tubular pipe are composed of an identical material.

4. The method of claim 3, wherein the tubular pipe includes aluminum.

5. The method of claim 1, wherein the filler comprises any one or more selected from salt, sand, iron powder, or a resin coated sand.

6. The method of claim 1, wherein a thickness of the tubular pipe is greater than 1.25 mm or more and less than 4 mm.

* * * * *